United States Patent [19]

Goto

[11] Patent Number: 4,734,062

[45] **Date of Patent: * Mar. 29, 1988**

[54] ELECTRICAL CONNECTOR

[75] Inventor: Kazuhiro Goto, Markham, Canada

[73] Assignee: AMP Incorporated, Harrisburg, Pa.

[ * ] Notice: The portion of the term of this patent subsequent to Feb. 9, 2005 has been disclaimed.

[21] Appl. No.: 937,774

[22] Filed: Dec. 4, 1986

[51] Int. Cl.[4] ..... H01R 11/01

[52] U.S. Cl. ..... 439/783; 439/781; 439/863

[58] Field of Search ..... 339/247, 248 R, 248 S, 339/249, 273 R, 273 F, 274

[56] References Cited

U.S. PATENT DOCUMENTS

| | | | |
|---|---|---|---|
| 1,466,735 | 9/1923 | Williams | 339/248 |
| 2,106,724 | 2/1938 | Cope | 339/273 R |
| 3,065,452 | 11/1962 | Osborn | 339/274 |
| 4,279,461 | 7/1981 | Bussen et al. | 339/246 |
| 4,533,205 | 8/1985 | Frank | 339/247 |

*Primary Examiner*—Eugene F. Desmond
*Assistant Examiner*—Paula A. Austin
*Attorney, Agent, or Firm*—Allan B. Osborne

[57] ABSTRACT

An electrical connector for electrically connecting two conductors. More particularly, the conductor includes a C-shaped body member having parallel, inwardly facing channels for receiving conductors therein and a pair of toggle blocks pivotally joined together and each having outwardly facing channels along one side. The toggle blocks, having a combined width greater than the space between conductors positioned in the channels in the C-shaped body member, compress the conductors therein when forced into the body member.

3 Claims, 3 Drawing Figures

ELECTRICAL CONNECTOR

FIELD OF THE INVENTION

This invention relates to an electrical connector for electrically and mechanically connecting two conductors together. More particularly, the connector is of the type including a C-shaped member and toggle blocks which compress the conductors into parallel channels in the C-shaped member.

BACKGROUND OF THE INVENTION

Electrical connectors of the type having a C-shaped body member having converging channels and a complementary wedge member have been known from at least as early as Apr. 21, 1931 when U.S. Pat. No. 1,801,277 issued to W. G. Kelley on an application filed May 18, 1926. Subsequent thereto a large number of patents disclosing different and improved embodiments have issued, including more recently U.S. Pat. Nos. 4,415,222 and 4,600,264. In each of the disclosures, the basic Kelley concept was followed; i.e., two conductors are electrically and mechanically connected by being pressed into and against interior curved surfaces or channels provided in a C-shaped body member by a wedge being driven longitudinally into the body member between the conductors.

It is now proposed to provide an electrical connector wherein the conductors are forced into parallel channels in a C-shaped body member by a pair of toggle blocks being pressed into the body member in a direction normal to the longitudinal axis.

SUMMARY OF THE INVENTION

According to the invention, an electrical connector is provided which includes an elongated C-shaped body member having parallel, inwardly facing conductor-receiving channels along each longitudinal side and a pair of toggle blocks pivotally joined together which have a combined width greater than the space between conductors positioned in the channels so that upon forcing the toggle blocks into the body member, the conductors are mechanically gripped and electrically interconnected.

DESCRIPTION OF THE INVENTION

Figure 1:
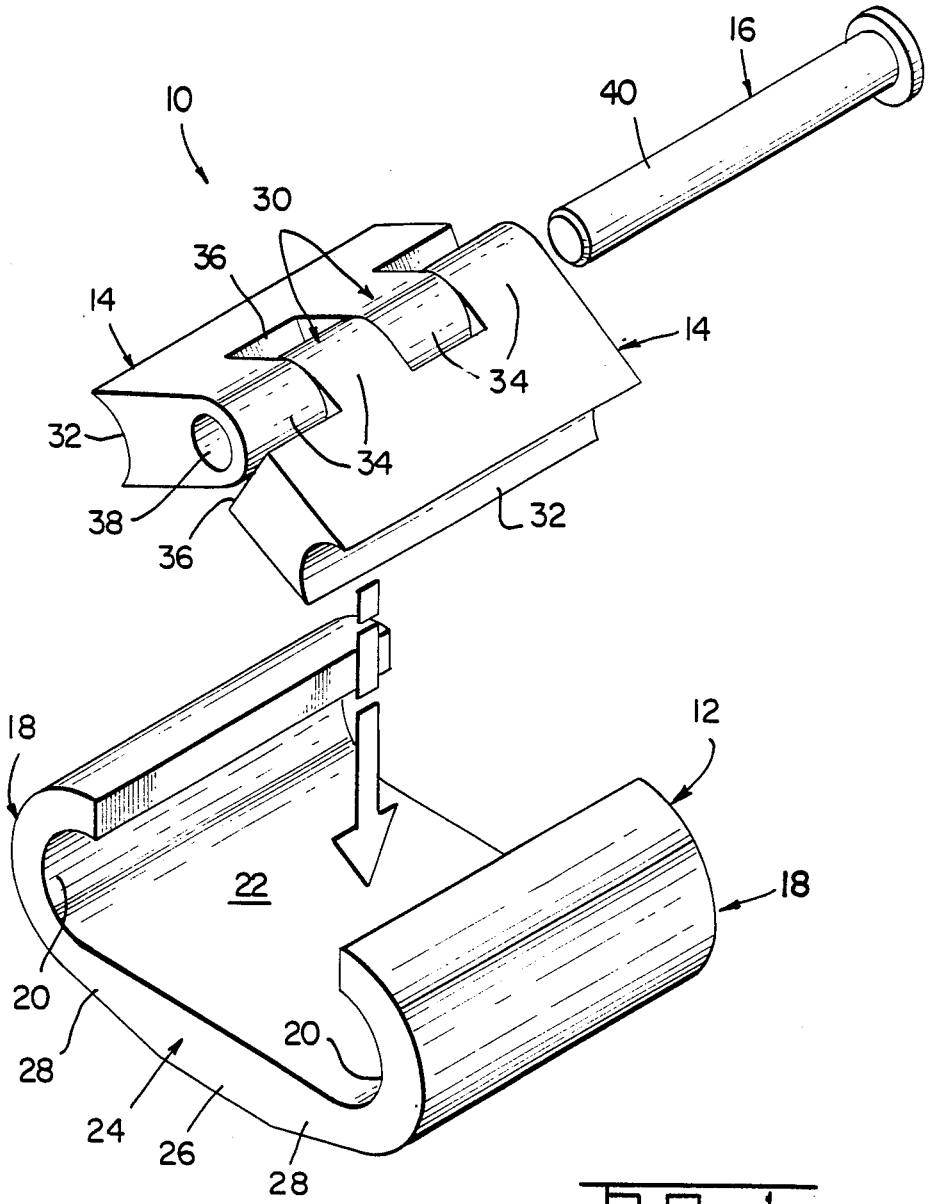
FIG. 1 is an exploded, perspective view of the electrical connector of the present invention showing the components thereof.

With reference to FIG. 1, the components of electrical connector 10 include C-shaped body member 12, a pair of toggle blocks 14 and hinge pin 16. Preferrably, body member 12 and toggle blocks 14 are made from 6061-T-6 aluminum. Pin 16 is made from stainless steel.

C-shaped body member 12 is preferrably extruded with the longitudinal edges rolled over to define channel portions 18 and to provide interior curved, parallel channels 20. Channels 20 face each other across surface 22 of wall 24 which joins channel portions 18. Channels 20 are dimensioned to conformably receive a range of conductor sizes; e.g. from 795 26/7 ACSR to 636-37 AAC.

Wall 24 of body member 12 is thickest along longitudinally extending middle portion 26 relative to parallel side portions 28 which are in between and joins channel portions 18 to middle portion 26. As shown, the thickness of side portions 28 decreases outwardly from middle portion 26. The outward thinning of side portions 28 facilitates outward flexing of channel portions 18. It should be noted, however, that wall 24 need not have a differential thickness; i.e., it can be of a uniform thickness without detrimental effect on the operation of the connector 10.

With respect to toggle blocks 14, hinge sections 30 are provided on one longitudinal side and outwardly facing channels 32 are provided on the opposing side. Blocks 14 are identical with channels 32 being dimensioned to cooperate with channels 20 in body member 12. In this respect, channel 32 on one block 14 and a respective channel 20 may be of a different arcuate dimension relative to channel 32 on the other block 14 and other channel 20.

Hinge sections 30 include a pair of spaced apart ears 34 projecting outwardly from side surface 36. Pin-receiving holes 38 are provided in each ear 34.

Toggle blocks 14 are sized so that their combined width is greater than the space between conductors positioned in respective channels 20 in body member 12. The excess width is such that upon pushing blocks 14 into that space, the conductors are compressed and mechanically gripped and, by reason of the conductivity of body member 12, toggle blocks 14 and pin 16, are electrically interconnected.

Blocks 14 are preferrably made by well known casting techniques.

Pin 16 includes shaft 40 which is dimensioned to be snugly received in holes 38 in ears 34. Pin 16 may include an upset or head on one end as shown but such is not necessary.

Toggle blocks 14 are pivotally joined together by interfingering ears 34 on respective blocks 14, as shown in FIG. 1, and sliding shaft 40 of pin 16 through aligned holes 38.

Figure 2:
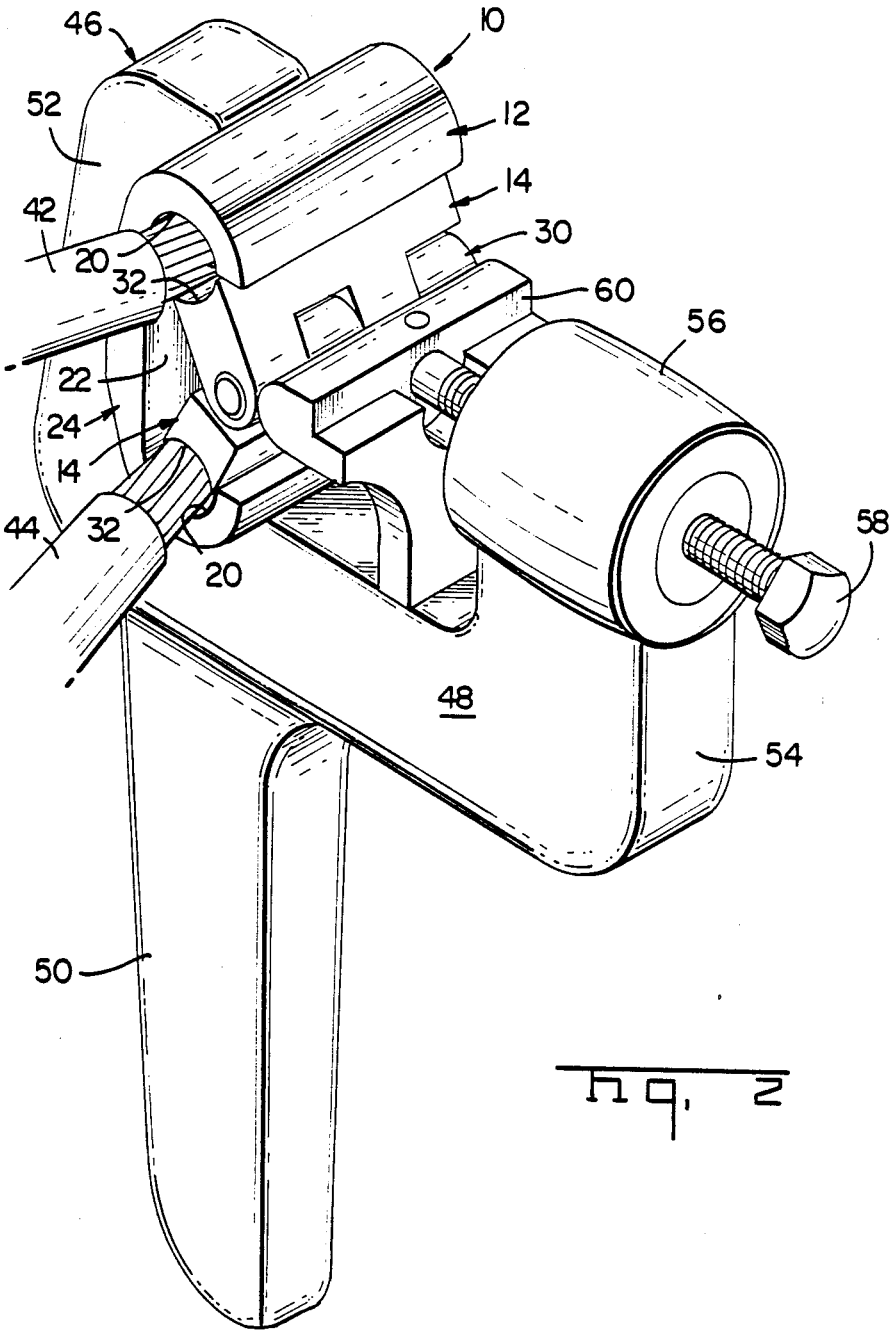
FIGS. 2 and 3 are perspective views showing a tool and the connecting of two conductors in the electrical connector of FIG. 1.
Figure 3:
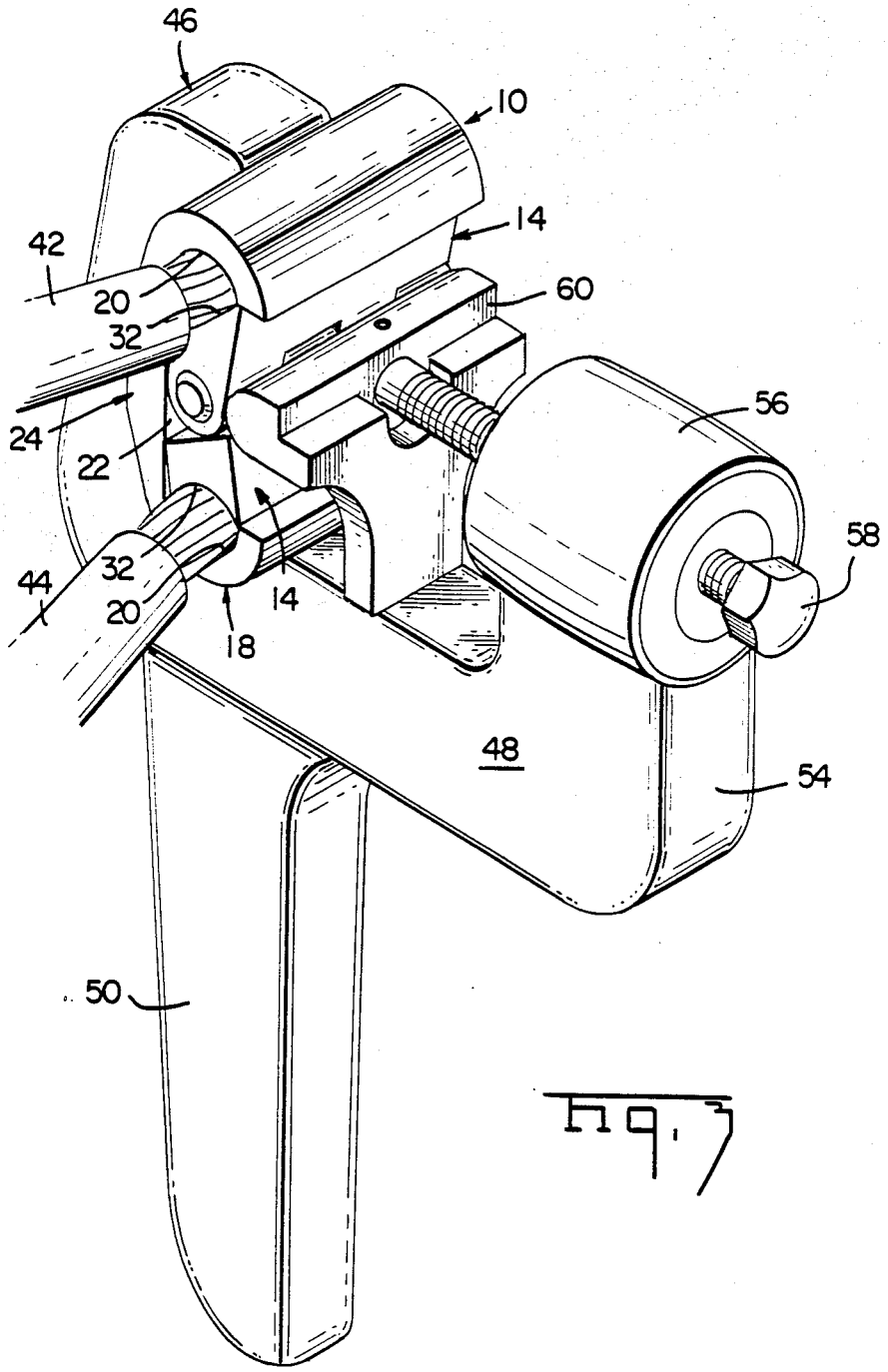

FIGS. 2 and 3 illustrate how conductors 42, 44 are electrically interconnected and mechanically gripped in connector 10. Tool 46, which is used to force blocks 14 into body member 12, includes tool head 48 mounted on handle 50. U-shaped head 48 includes back arm 52 against which connector 10 is positioned. Front arm 54 includes housing 56, bolt 58 threadly mounted in housing 56 and T-shaped bar 60, located between arms 52, 54 and moved therebetween by bolt 58 to which it is attached.

Portions of conductors 42, 44 with their insulation jackets removed are placed in respective channels 20 in body member 12. Toggle blocks 14, joined together as described above, are positioned in body member 12 with respective channels 32 abutting conductors 42, 44 and hinge sections 30 projecting outwardly as shown in FIG. 2. With the back of connector 10 against back arm 52 of tool 46, bar is advanced against blocks 14 by turning bolt 58 clockwise to force toggle blocks 14 in between conductors 42, 44 and against surface 22 of wall 24 as shown in FIG. 3. In accommodating the width of blocks 14, conductors 42, 44 are compressed tightly between respective channels 20 in body member 12 and respective channels 32 in blocks 14 and are accordingly electrically interconnected and mechanically gripped. To the extent required by the dimensions of conductors 42, 44, channel portions 18 are resiliently spread apart which insures continued compressive forces on conductors 42, 44 even in the event of conductor creep, a well known phenomenon experienced by aluminum cables and wires.

As shown in FIG. 3, toggle blocks 14 are pushed over center which locks them in position and insures integrity of connector 10.

During the aforementioned compression of conductors 42, 44, the individual strands rub against each other and oxides and dirt are wiped therefrom to enhance the electrical connection. Further, the connection is very tight which reduces the incident of corrosion.

Another feature of the present invention is that connector 10 may be used repeatedly.

As can be discerned, an electrical connector for electrically connecting and mechanical gripping two conductors has been disclosed. The connector includes a C-shaped body member having parallel and facing conductor-receiving channels and a pair of hinged toggle blocks which are received in the body member between the channels. The combined width of the toggle blocks exceed the space between conductors positioned in the channels so that they are compressed and mechanically confined upon forcing the toggle blocks therebetween. The conductivity of the body member and toggle blocks provide an electrical interconnection between the conductors.

I claim:

1. An electrical connector for electrically connecting two electrical conductors, said connector comprising:

conductive, elongated, C-shaped body means having parallel, inwardly facing conductor-receiving channel means on each longitudinal side of and attached to intervening wall means; and a pair of conductive toggle block means pivotally joined together along one side and each having outwardly facing, conductor-receiving channel means along an opposite side, said toggle block means having a combined width greater than the space between conductors disposed in respective said channel means in said body means, said toggle block means adapted to be forced into said body means with said outwardly facing channel means facing and cooperating with respective said channel means is said body means to grip and electrically interconnect conductors which may be disposed therebetween.

2. The electrical connector of claim 1 wherein said toggle block means include spaced apart ears extending outwardly from said one side with holes therethrough for receiving hinge means.

3. The electrical connector of claim 2 wherein said hinge means includes a pin received in said holes in said ears.

* * * * *